US007362981B2

(12) United States Patent
Masui

(10) Patent No.: US 7,362,981 B2
(45) Date of Patent: Apr. 22, 2008

(54) IMAGE FORMING APPARATUS, METHOD FOR CONTROLLING THE SAME AND STORAGE MEDIUM FOR STORING PROGRAM

(75) Inventor: Takanori Masui, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 11/048,872

(22) Filed: Feb. 3, 2005

(65) Prior Publication Data

US 2005/0260002 A1 Nov. 24, 2005

(30) Foreign Application Priority Data

May 19, 2004 (JP) ..... 2004-148477

(51) Int. Cl.
*G03G 15/00* (2006.01)

(52) U.S. Cl. ..... 399/12; 399/24

(58) Field of Classification Search ..... 399/12, 399/24

See application file for complete search history.

(56) References Cited

U.S. PATENT DOCUMENTS 4,961,088 A * 10/1990 Gilliland et al. ..... 399/25
6,029,018 A * 2/2000 Rogers et al. ..... 399/12
6,158,837 A * 12/2000 Hilton et al. ..... 347/19
6,738,903 B1 * 5/2004 Haines ..... 399/12
6,912,364 B2 * 6/2005 Kim ..... 399/12
2001/0028800 A1 * 10/2001 Kim ..... 399/12
2004/0234279 A1 * 11/2004 Ito et al. ..... 399/12

FOREIGN PATENT DOCUMENTS

JP 2001-337565 12/2001

OTHER PUBLICATIONS

Chinese Office Action dated Aug. 17, 2007 and English translation for Chinese counterpart to U.S. Appl. No. 11/048,872.

* cited by examiner

*Primary Examiner*—David M. Gray
*Assistant Examiner*—Ryan D. Walsh
(74) *Attorney, Agent, or Firm*—Morgan, Lewis & Bockius LLP

(57) ABSTRACT

An image forming apparatus, provided with replacement parts each having a storage section therein and adapted to be detachably attached to the image forming apparatus and with an image forming unit arranged to form an image on a printing medium, includes: an information reading section that reads information from the storage section of at least one of the replacement parts; a certified part determining section that determines whether the replacement part is a certified part or not based on the information read from the storage section; and an image forming possibility determining section that determines whether or not image forming is possible using the replacement part determined to be a certified part by the certified part determining section. The image forming unit executes image forming using the replacement part determined to be a certified part if the image forming possibility determining section has determined that image forming is possible.

20 Claims, 5 Drawing Sheets

| | CERTIFIED PART | UNCERTIFIED PART | |
|---|---|---|---|
| MEMORY-READING | ○ | ○ | × |
| DATA VERIFICATION | ○ | × | × |

IMAGE FORMING APPARATUS, METHOD FOR CONTROLLING THE SAME AND STORAGE MEDIUM FOR STORING PROGRAM

BACKGROUND OF THE INVENTION

1. Field of the Invention

The present invention relates generally to an image forming apparatus for color printing, and, more particularly, to an image forming apparatus that detects whether a process cartridge, etc., that is removably attached to the image forming apparatus for use is a certified part or an uncertified part and that enables image forming by changing an image process without disabling all image forming functions of the image forming apparatus, as well as to a method for controlling the image forming apparatus and a storage medium for storing a program for controlling the image forming apparatus.

2. Description of the Related Art

Common image forming apparatuses employing an electrophotography scheme such as printers, copiers, fax machines, or the like, form images by first forming a latent image through selective exposure of a photosensitive drum that is uniformly charged, developing this latent image into a visible image with toner that is the developing agent, and then transferring the toner image onto a printing medium.

Because the toner is consumed in this manner, the toner must be replenished for the image forming apparatus every time the toner has run out. However, the refilling or replenishing the toner is a burdensome, and often dirty, task. Complicating the matter, for many machines, only dedicated service staff are able or allowed to perform such maintenance of the image forming apparatus.

On the other hand, some known image forming apparatuses facilitate maintenance by employing a process cartridge which integrates a developing apparatus, and other units into a single structure which is freely detachable from the main body of the image forming apparatus. Such a configuration enables a user to simply replace the process cartridge when the toner has been used up or when a part such as a developing roller, or the like has reached the end of its service life.

One such apparatus is configured as a color image forming apparatus, a rotation-switching-type (rotary-type) color developing apparatus, or a tandem-type color developing apparatus which is provided with four developing cartridges, each accommodating a respective developing unit for each of four colors of black, cyan, magenta, and yellow. In this apparatus, each of the cartridges is freely detachable from the main body of the apparatus.

Such cartridge-type image forming apparatuses are designed with the intent that users will replace the cartridges themselves. Therefore, means are necessary for notifying the user of the fact that the toner level is low or that a part such as a developing roller, or the like has reached the end of its service life.

A method has also been presented and employed that enables data on the amount of used toner in a cartridge to be stored by providing a nonvolatile memory such as an EEPROM or the like to the cartridge for detecting the life of a part or the toner consumption, and by accumulating in the memory the data on the amount of toner used. For example, when the photosensitive drum is exposed using a laser, section for adding and storing information of exposure time and information relating to the amount of remaining toner may be provided.

Usually, a manufacturer of an image forming apparatus assumes that replacement parts for which the manufacturer can confirm the safety, such as original or certified replacement parts, will be attached, and designs and manufactures the main body of the apparatus such that predetermined image quality and safety performance can be obtained under those conditions.

When replacement parts of which use is not certified (uncertified parts) such as imitations, counterfeits, pirated copies, etc., are attached to the main body of the apparatus designed and manufactured as above, their operation is beyond the scope of the manufacturer's assumptions. Therefore, a user may suffer from various disadvantages. For example, problems with image quality, malfunctions, faults in the main body of the apparatus, physical damage of the printing paper (tearing, wrinkling, etc.,), or serious accidents (noise, smells, sparking, smoking, explosions, etc.,) may occur.

In order to avoid the above disadvantages, a technique is employed, for automatically determining whether or not an attached replacement part is an original or authorized part or the like, and, when the attached replacement part is not an authorized part, prohibiting the image forming operation or displaying an alarm (See, for example, Japanese Patent Application Laid-Open Publication No. 2001-337565).

As described above, use of a replacement part (herein after referred to as "CRU (Customer Replaceable Unit)") which use is not certified by the manufacturer such as an imitation (uncertified part) is not preferable from the viewpoints of safety and other considerations, However, among consumers, many consumers desire to use uncertified parts, not only for image forming apparatuses but also widely for apparatuses to which CRUs can be attached. Despite this, in the conventional technique, the image forming function is completely disabled, even when even only one uncertified CRU is detected.

Then, when, in a color image forming apparatus, it should still be possible to form or print an image using just the certified parts, all image forming is prohibited, which clearly inconveniences consumers.

SUMMARY OF THE INVENTION

In consideration of the above, the present invention provides an apparatus that enables changing of a color image forming process, without completely disabling image forming functions, even when a CRU that has not been certified by the manufacturer is attached to a color image forming apparatus.

According to an aspect of the present invention, an image forming apparatus, provided with one or more replacement parts each having a storage section therein and adapted to be detachably attached to the image forming apparatus and with an image forming unit arranged to form an image on a printing medium, the image forming apparatus, includes: an information reading section that reads information from the storage section of at least one of the replacement parts; a certified part determining section that determines whether the at least one replacement part is a certified part or not based on the information read from the storage section of the replacement part; and an image forming possibility determining section that determines whether or not image forming is possible using the at least one replacement part determined to be a certified part by the certified part deter mining section. The image forming unit executes image forming using the at least one replacement part determined to be a certified part if the image forming possibility determining section has determined that image forming is possible.

BRIEF DESCRIPTION OF THE DRAWINGS

An embodiment of the present invention will become more apparent from the following detailed description when taken in conjunction with the accompanying drawings, in which.

DETAILED DESCRIPTION OF THE INVENTION

An embodiment of the present invention will now be described with reference to the drawings.

Figure 1:
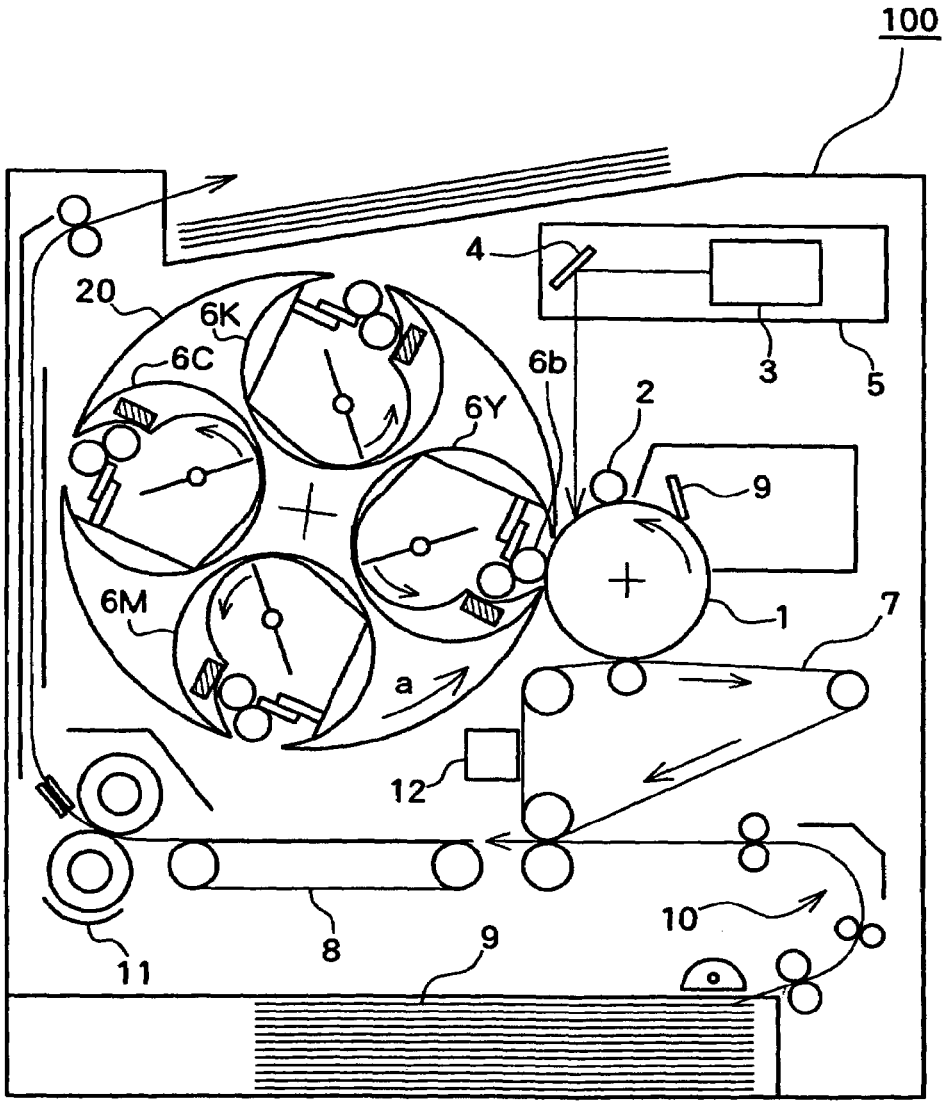
FIG. 1 generally shows the configuration of an image forming apparatus using an electrophotography process according to an embodiment of the present invention.

FIG. 1 generally shows the configuration of an image forming apparatus using an electrophotography process according to this embodiment. The image forming apparatus is a laser printer or the like capable of forming four-color, full-color images, using toner of yellow (Y), magenta (M), cyan (C) and black (K).

1. Configuration

An image forming apparatus 100 comprises a rotary developer 20 having developing cartridges 6 of four colors. Each of the developing cartridges 6 is provided with a developing agent carrier roller 6*b* facing a photosensitive drum 1 and an electrostatic latent image can be developed for each of the colors on the photosensitive drum 1 by the developing agent carrier roller 6*b*.

In order to form an image, the photosensitive drum 1 having a drum-like shape, a first image carrier, is driven by a driving section not shown. The image forming apparatus 100 has a charger 2 and an exposing unit 5, consisting of a laser-light-transmitting unit 3 and a mirror 4, that forms an electrostatic latent image on the photosensitive drum 1 by irradiating a laser-light beam based on image information.

The image forming apparatus 100 further comprises developing cartridges 6 having, integrating therein, a developing section for forming a toner image by applying toner to the electrostatic latent image as the developing agent and a cleaning unit 9 for removing toner remaining after transfer on the surface of the photosensitive drum 1 after the primary transfer.

A transfer belt 7 is a second image carrier and has a cleaning unit 12 that removes toner remaining after transfer on the surface after the primary transfer of a toner basic image on the photosensitive drum 1. A paper sheet 9 is conveyed at a predetermined timing from a paper feeding unit 10 and the transfer belt 7 executes a secondary transfer onto the surface of the paper sheet 9.

Furthermore, the paper sheet 9 is conveyed by a conveyer 8, passed through a fixing unit 11 that fixes a toner image on the paper sheet 9 after the secondary transfer to the paper sheet 9 by heating and pressuring this toner image; and then conveyed to an ejecting tray.

Figure 2:
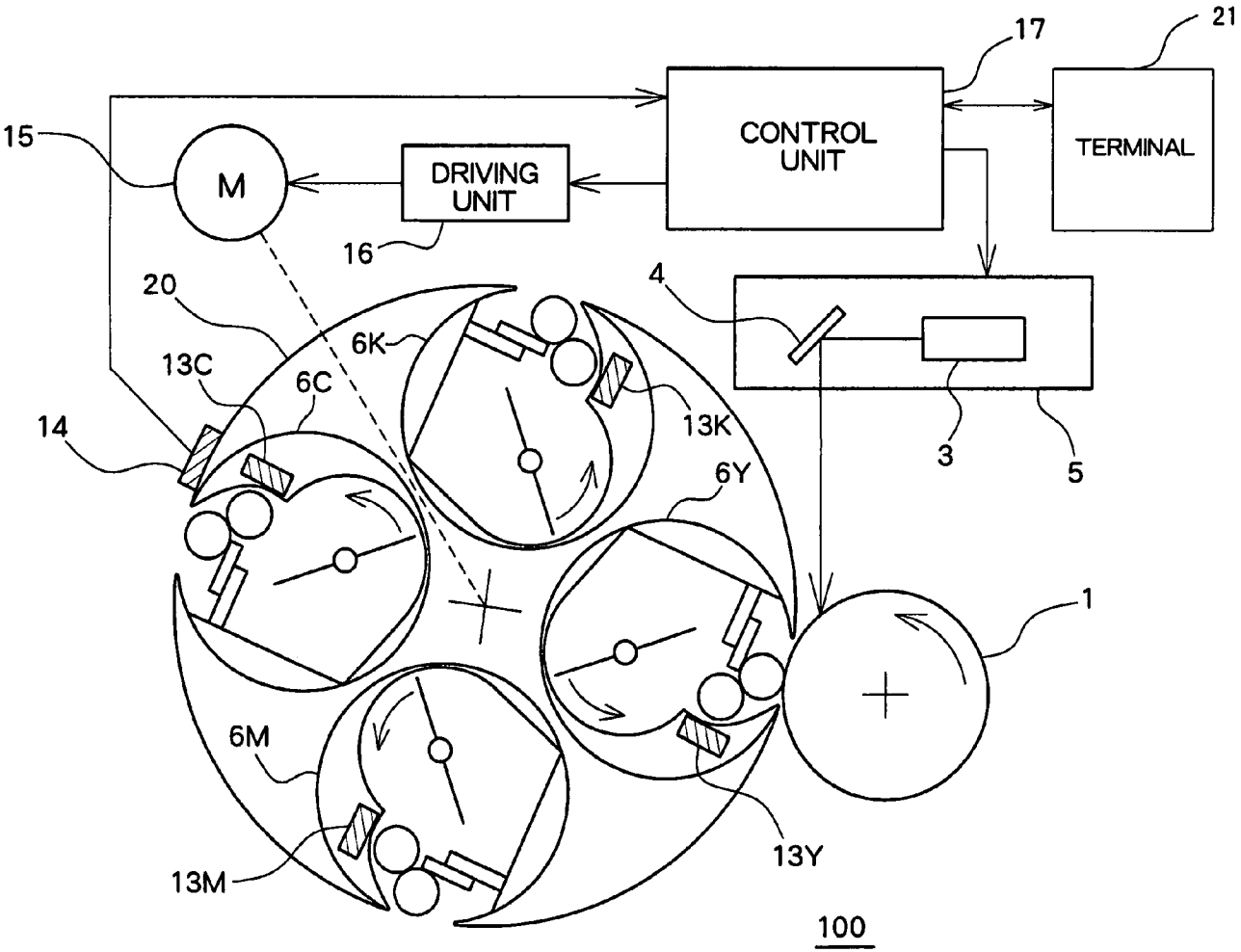
FIG. 2 is a block diagram of a section that drives a rotary developer and reads CRU memory data, in the embodiment of the present invention.

FIG. 2 is a block diagram showing a section that drives the rotary developer 20 and reads CRU memory data in this embodiment. The developing cartridges (6Y, 6M, 6C and 6K) respectively of each color are attached to the rotary developer 20 and a wireless transceiver 14 communicates with a nonvolatile memory unit 13 of each of the developing cartridges using radio and stores parameter information, such as the number of copies printed using each developing cartridge, the amount toner remaining, etc., into the nonvolatile memory unit 13. For example, when the developing cartridge 6Y has come to a position at which the developing cartridge 6Y faces the photosensitive drum 1, the wireless transceiver 14 and a nonvolatile memory unit 13C of the developing cartridge 6C can communicate with each other.

The parameter information having been read is captured by a control unit 17 which is connected to a terminal 21. The control unit 17 rotates the rotary developer 20 by controlling a driving unit 16 that drives a motor 15 in order to read parameter information of the next cartridge 6K. Repeating the same operations, parameter information in the nonvolatile memory units 13 of the developing cartridges attached to the rotary developer 20 is read.

2. Process Operations

Figure 3:
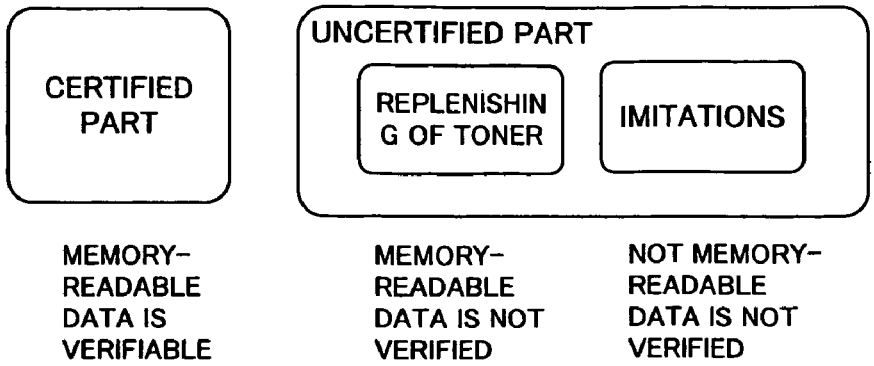
FIG. 3 is a schematic diagram showing conditions for determining whether a part is a certified part or an uncertified part in the embodiment of the present invention.

FIG. 3 is a schematic diagram showing conditions for determining whether a part is a certified part or an uncertified part, according to this embodiment. In general, in the nonvolatile memory unit 13 of a certified part certified by the manufacturer of the image forming apparatus will be stored parameter information which can be read from the nonvolatile memory unit 13. This data is generally encrypted and, therefore, can be decrypted or verified only with a predetermined encryption key controlled by the manufacturer.

In general, among the parts other than the certified parts may be found parts in which a party other than the original manufacturer has refilled toner or imitations manufactured by a business entity other than the original manufacturer, and those parts include parts for which data read from the nonvolatile memory units 13 cannot be decrypted or verified with the predetermined encryption key, although reading of the nonvolatile memory units 13 may be possible.

In this embodiment, it is assumed that preset settings include a setting instructing the device to determine whether it is possible to store and read data from a part and whether the data from the part can be decrypted and used to verify whether the part is a certified part.

It is also possible, however, to define a certified part as any part whose memory can be read.

Table 1 shows combinations of colors that can be used. This information is displayed on a user interface (not shown) of the image forming apparatus when an image forming process is changed in order to enable printing even when each of the developing cartridges 6 for black (K), yellow (Y), magenta (M) and cyan (C) is determined to be an uncertified part or out of order using the determination method described above.

TABLE 1

| K (BLACK) | Y (YELLOW) | M (MAGENTA) | C (CYAN) |
|---|---|---|---|
| YMC BLACK OUT OF ORDER | | | |
| | K + M<br>K + MC<br>K + C<br>YELLOW OUT OF ORDER | | |
| | | K + Y<br>K + YC<br>K + C<br>MAGENTA OUT OF ORDER | |
| | | | K + Y<br>K + YM<br>K + M<br>CYAN OUT OF ORDER |

A method of changing the image forming process using Table 1 will be described. In an example wherein the cartridge 6 for black (K) is an uncertified part or is out of order, printing is executed by creating the color black from a mixture of yellow (Y), magenta (M) and cyan (C).

When the cartridge 6 for yellow (Y) is an uncertified part or is out of order, two-color printing can be secured by selecting black (K) and colors other than yellow (Y). Similarly, in the case where the cartridges 6 for magenta (M) and cyan (C) are uncertified parts or are out of order, it is still possible to print recognizable images.

Figure 4:
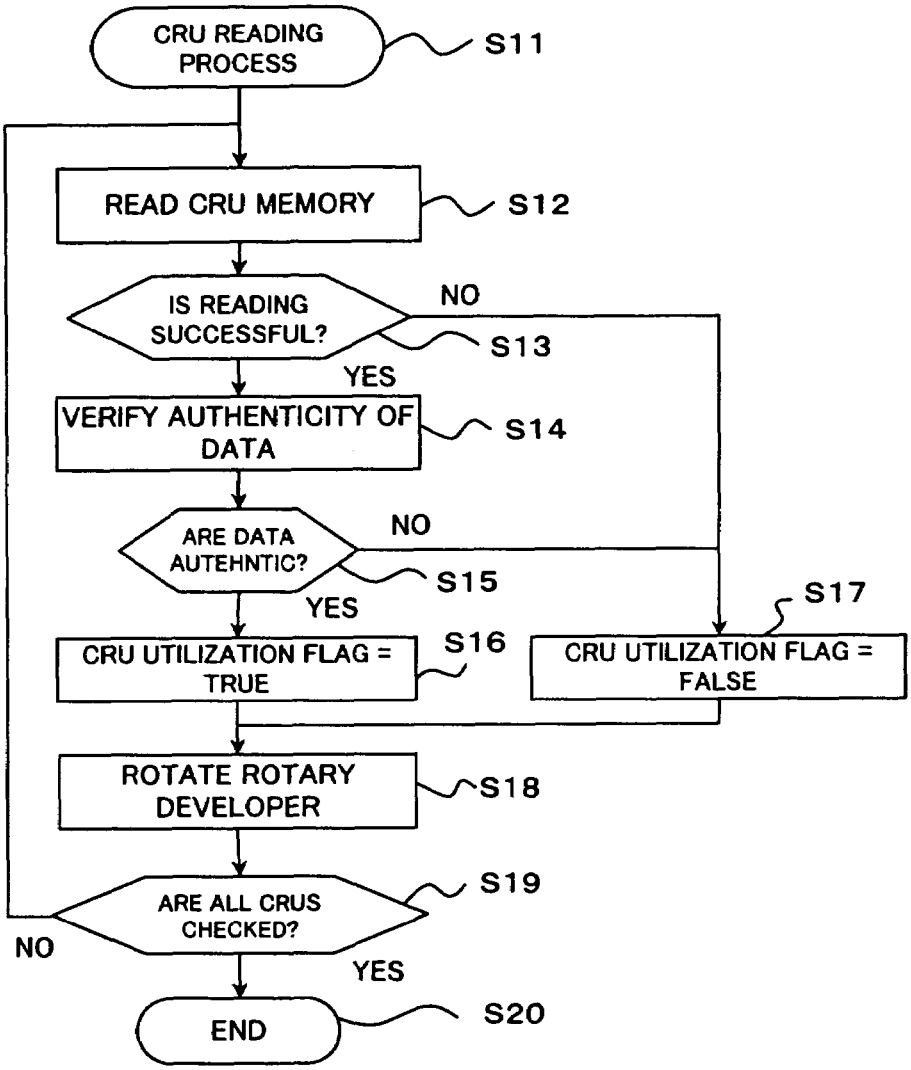
FIG. 4 is a flowchart showing the flow of a reading process for the CRU memory data in the embodiment of the present invention.

FIG. 4 is a flowchart showing the flow of a reading process for the CRU memory data in the embodiment. When the reading process for a CRU is started at step S11, reading from the CRU memory is executed at step S12.

When the reading is successfully finished, decryption or verification of the read data is executed at step S13. Consequently, if the data is determined to be authentic at step S15, a CRU utilization flag is set at "TRUE" at step S16. Next, the rotary developer is rotated in order to check the next CRU at step S18. When all of the CRUs have been checked, the CRU reading process is ended.

When the settings of the image forming apparatus 100 are such that a part for which memory-reading is possible is determined to be a certified part, the operations at step S14 and step S15 are not necessary and, when reading is successfully finished at step S13, the CRU utilization flag is set at "TRUE" at step S16 wherein the part is determined to be a certified part.

However, when the reading of data has failed at step S13, the CRU utilization flag is set at "FALSE" at step S17 and the rotary developer is rotated at S18 in order to check the next CRU.

Moreover, when the decryption or verification of the cryptogram fails at step S14 even though the reading at step S13 was successful, the CRU utilization flag is set at "FALSE" at step S17, and the part is determined to be an uncertified part or to be out of order. These determination results are stored in a memory inside the control unit 17.

Figure 5:
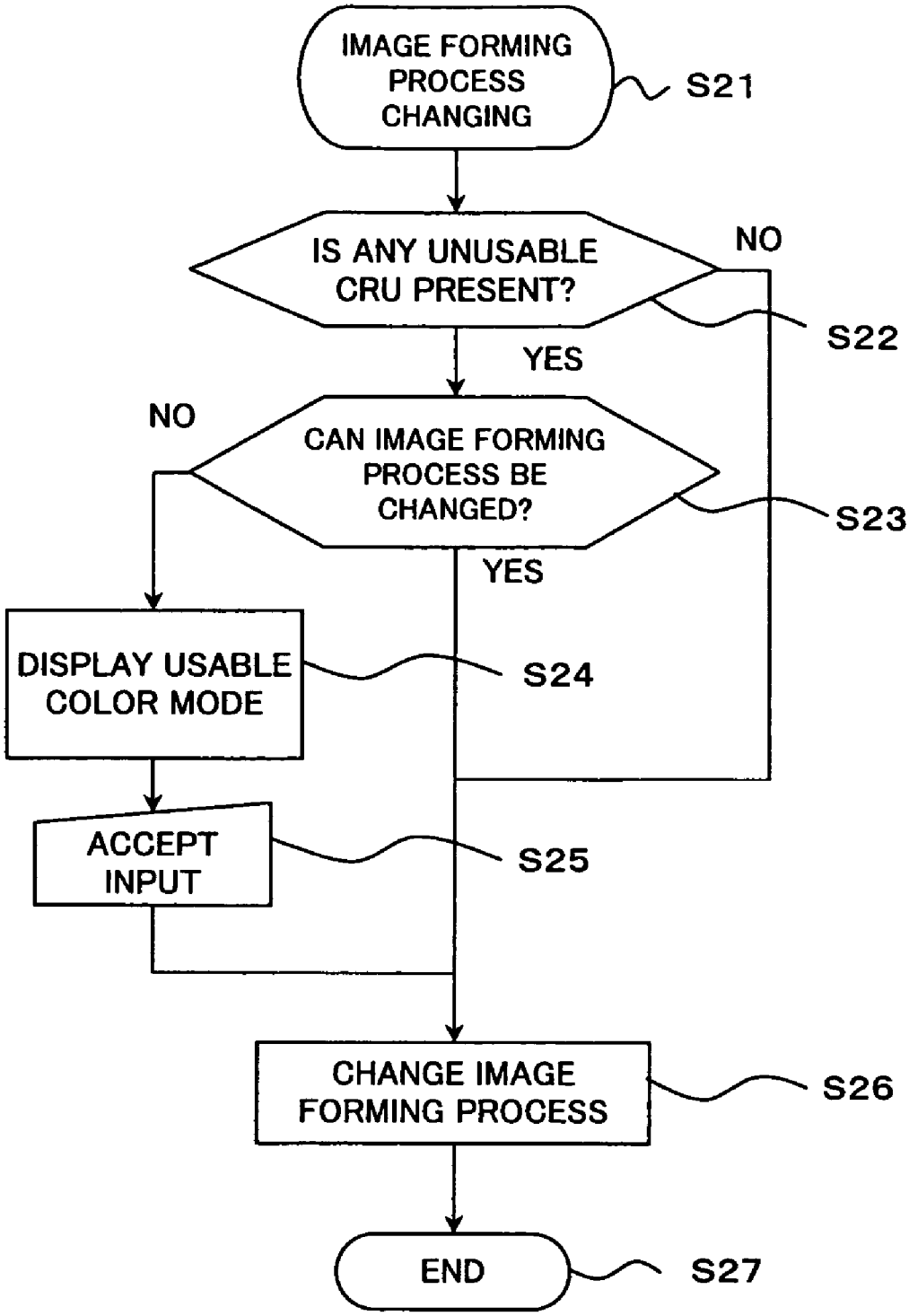
FIG. 5 is a flowchart showing the flow of a changing process for the image forming process in the embodiment of the present invention.

FIG. 5 is a flowchart showing the flow of a changing process for the image forming process in the embodiment. The flow of a process for changing the image forming process in an example wherein the reading process of the CRU memory data has been finished and unusable CRUs are present will be described.

The image forming process changing process is started at step S21. Next, whether or not any unusable CRUs are present is determined at step S22. If any unusable CRUs are present, a step S23 is executed to determine whether or not the image forming process can be changed. When, for example, it is determined that the cartridge 6 for black (K) is unusable, it is determined that black should be obtained by mixing the three colors of Y, M and C and, at step S26, the image forming process is changed to a process that obtains the color black in this manner.

If the colors other than black are unusable, usable color modes shown in Table 1 are displayed on a display unit of the image forming apparatus at step S24 and an input for a selected color that the user has selected is obtained at step S25. Thereafter, the image forming process is changed at step S26 and the image forming process changing process is ended.

As described above, the present invention relates to an image forming apparatus for color printing, and improves the convenience of users using an image forming apparatus. The present invention also provides a method and a control program for an image forming apparatus that discover defects by reading and writing data from process cartridges, etc., that are detachably attached to the image forming apparatus while detecting whether such parts are certified parts or uncertified parts, and enables image forming by changing an image forming process or in specific color modes without completely disabling the image forming functions of the image forming apparatus.

The replacement part or the CRU may be a process cartridge, developing cartridge, intermediate transfer unit, or fixing unit, and the present invention can obviously be applied an image forming apparatus using toner of more than four (4) colors.

While the illustrative embodiment of the present invention has been described in detail herein, it is to be understood that the present invention may be otherwise variously embodied and employed and that the appended claims are intended to be construed to include all such variations except insofar as limited by the prior art.

The entire disclosures of Japanese Patent Application No. 2004-148477 filed on May 19, 2004 including specification, claims, drawings, and abstract is incorporated herein by reference.

What is claimed is:

1. An image forming apparatus provided with a plurality of replacement parts each having a storage section therein and adapted to be detachably attached to the image forming apparatus and with an image forming unit arranged to form an image on a printing medium, the image forming apparatus comprising:

an information reading section that reads information from the storage section of each replacement part;

a certified part determining section that determines whether each replacement part is a certified part based on the information read from the storage section of the respective replacement part; and an image forming possibility determining section that, when at least one replacement part but fewer than all replacement parts is determined to be a certified part, determines whether image forming is possible using only the at least one replacement part determined to be a certified part by the certified part determining section, wherein the image forming unit executes image forming if the image forming possibility determining section has determined that image forming is possible.

2. The image forming apparatus according to claim 1, wherein the certified part determining section determines that the at least one replacement part is a certified part if the information is successfully read from the storage section of the replacement part.

3. The image forming apparatus according to claim 1, wherein the certified part determining section comprises a verifying section that verifies authenticity of the information acquired by the information reading section, and wherein the certified part determining section determines that the at least one replacement part is a certified part if the authenticity of the information is verified, and that the replacement part is not a certified part if the authenticity of the information is not verified.

4. The image forming apparatus according to claim 3, wherein the verifying section verifies the authenticity of the information acquired by the information reading section based on whether or not the information that has been encrypted can be correctly decrypted.

5. The image forming apparatus according to claim 1, further comprising:

a process determining section that determines one or more color image forming processes which are available by using the at least one replacement part determined to be a certified part; and a process changing section that changes a predetermined color image forming process to one of the color image forming processes determined to be available by the process determining section.

6. The image forming apparatus according to claim 5, further comprising:

an inputting and outputting section that displays information on the color image forming processes which are available by using the at least one replacement part determined to be a certified part, and receives an input from a user which designates one of the available color image forming processes.

7. The image forming apparatus according to claim 1, wherein the replacement part is one of a process cartridge, a developing cartridge, an intermediate transfer unit and a fixing unit.

8. A method of controlling an image forming apparatus provided with a plurality of replacement parts each having a storage section therein and adapted to be detachably attached to the image forming apparatus and with an image forming unit arranged to form an image on a printing medium, the method comprising:

reading information from the storage section of each replacement part;

determining whether each replacement part is a certified part based on the information read from the storage section of the respective replacement part; and when at least one replacement part but fewer than all replacement parts is determined to be a certified part, determining whether image forming is possible using only the at least one replacement part determined to be a certified part, wherein the image forming unit executes image forming if image forming is determined to be possible.

9. The method of controlling an image forming apparatus according to claim 8, wherein, in the certified part determining step, the at least one replacement part is determined to be a certified part if the information is successfully read from the storage section of the replacement part.

10. The method of controlling an image forming apparatus according to claim 8, wherein the certified part determining step comprises verifying authenticity of the information acquired in the information reading step, and wherein the at least one replacement part is determined to be a certified part if the authenticity of the information is verified, and the replacement part is determined not to be a certified part if the authenticity of the information is not verified.

11. The method of controlling an image forming apparatus according to claim 10, wherein the authenticity of the information is verified based on whether or not the information that has been encrypted can be correctly decrypted.

12. The method of controlling an image forming apparatus according to claim 8, further comprising:

determining one or more color image forming processes which are available by using the at least one replacement part determined to be a certified part; and changing a predetermined color image forming process to one of the color image forming processes determined to be available by the process determining step.

13. The method of controlling an image forming apparatus according to claim 12, further comprising:

displaying information on the color image forming processes which are available by using the at least one replacement part determined to be a certified part; and receiving an input from a user which designates one of the available color image forming processes.

14. The method of controlling an image forming apparatus according to claim 8, wherein the replacement part is one of a process cartridge, a developing cartridge, an intermediate transfer unit and a fixing unit.

15. A storage medium readable by a computer, the storage medium storing a program of instructions executable by the computer to perform a function for controlling an image forming apparatus provided with a plurality of replacement parts each having a storage section therein and adapted to be detachably attached to the image forming apparatus and with an image forming unit arranged to form an image on a printing medium, the function comprising:

reading information from the storage section of each replacement part;

determining whether each replacement part is a certified part based on the information read from the storage section of the respective replacement part; and when at least one replacement part but fewer than all replacement parts is determined to be a certified part, determining whether image forming is possible using only the at least one replacement part determined to be a certified part, wherein the image forming unit executes image forming if image forming is determined to be possible.

16. The storage medium according to claim 15, wherein, in the certified part determining step, the at least one replacement part is determined to be a certified part if the information is successfully read from the storage section of the replacement part.

17. The storage medium according to claim 15, wherein the certified part determining step comprises verifying authenticity of the information acquired in the information reading step, and wherein the at least one replacement part is determined to be a certified part if the authenticity of the information is verified, and the replacement part is determined not to be a certified part if the authenticity of the information is not verified.

18. The storage medium according to claim 17, wherein the authenticity of the information is verified based on whether or not the information that has been encrypted can be correctly decrypted.

19. The storage medium according to claim 15, the function further comprising:

determining one or more color image forming processes which are available by using the at least one replacement part determined to be a certified part; and changing a predetermined color image forming process to one of the color image forming processes determined to be available by the process determining step.

20. The storage medium according to claim 19, the function further comprising:

displaying information on the color image forming processes which are available by using the at least one replacement part determined to be a certified part; and receiving an input from a user which designates one of the available color image forming processes.

* * * * *